US006482026B2

(12) United States Patent
Morita et al.

(10) Patent No.: US 6,482,026 B2
(45) Date of Patent: Nov. 19, 2002

(54) INSULATION DISPLACEMENT CONNECTOR WITH A PRESSURE-RECEIVING WALL FOR IMPROVED MANUFACTURING

(75) Inventors: Makoto Morita, Osaka (JP); Yusuke Hamada, Osaka (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/819,896

(22) Filed: Mar. 29, 2001

(65) Prior Publication Data

US 2001/0029125 A1 Oct. 11, 2001

(30) Foreign Application Priority Data

Mar. 30, 2000 (JP) ..... 2000-095953

(51) Int. Cl.[7] ..... H01R 11/20
(52) U.S. Cl. ..... 439/397
(58) Field of Search ..... 439/397–401, 439/406, 407, 417, 733.1

(56) References Cited

U.S. PATENT DOCUMENTS 5,458,502 A * 10/1995 Joly ..... 439/397
5,716,242 A * 2/1998 Myer ..... 439/748
5,879,181 A * 3/1999 Okabe ..... 439/397
5,967,842 A * 10/1999 Okabe ..... 439/596
6,012,942 A * 1/2000 Volstorf ..... 439/397
6,027,374 A * 2/2000 Nagai et al. ..... 439/596
6,109,982 A * 8/2000 Okabe et al. ..... 439/748
6,135,827 A * 10/2000 Okabe et al. ..... 439/731
6,224,416 B1 * 5/2001 Nagai ..... 439/400

FOREIGN PATENT DOCUMENTS

JP 3009653 12/1999

* cited by examiner

*Primary Examiner*—Brian Sircus
*Assistant Examiner*—Son V. Nguyen
(74) *Attorney, Agent, or Firm*—Oblon, Spivak, McClelland, Maier & Neustadt, P.C.

(57) ABSTRACT

In an insulation displacement connector including a connector housing, a connector housing rear half portion for receiving slots of contacts is provided on a side more rear than a support portion and an elastic arm in a locking mechanism. Electric wire insertion holes communicating with the slots are opened in a first outer wall surface located at one end of the connector housing rear half portion in a heightwise direction. A portion, corresponding to the slots, of a second outer wall surface opposite to the first outer wall surface is provided as a pressure-receiving wall for receiving an insulation displacement load.

12 Claims, 9 Drawing Sheets

INSULATION DISPLACEMENT CONNECTOR WITH A PRESSURE-RECEIVING WALL FOR IMPROVED MANUFACTURING

BACKGROUND OF THE INVENTION

1. Field of the Invention

The present invention belongs to a technical field of an insulation displacement connector having contacts for connecting cores of electric wires by insulation displacement. Particularly, the present invention relates to an insulation displacement connector in which an operation type locking mechanism to be engaged with a partner connector is provided in an outer wall of a connector housing.

2. Description of the Related Art

Conventionally, a crimp style connector having contacts for crimping cores of electric wires has been used widely. As such a crimp style connector, there is known a connector having an operation type locking mechanism provided in an outer wall of a connector housing so as to be engaged with a partner connector (for example, see Japanese Patent No. 3009653). The locking mechanism includes a support portion and an arm. The support portion is formed to protrude outward from the outer wall of the connector housing, and the arm has an engaging portion provided at a front end and shaped like a hook curved toward the outer wall, a gripping portion provided at a rear end, and an intermediate portion connected to the support portion. When the crimp style connector including the locking mechanism is connected to the partner connector, the engaging portion of the arm of the locking mechanism is engaged with an engaged portion of the partner connector so that the two connectors are connected to each other strongly. Hence, even in the case where the crimp style connector suffers draw-out force from the electric wires, the crimp style connector is hardly drawn out from the partner connector. Hence, connection failure can be prevented from occurring. When the gripping portion is pressed, the engagement is released so that the crimp style connector can be removed from the partner connector easily.

The operation of crimping electric wires to the crimp style connector is carried out by the steps of: overlapping cores of front ends of electric wires with end potions of contacts respectively; crimping the cores with barrels respectively while plastically deforming the barrels by a crimping tool; and inserting the contacts including the electric wire one by one into cavities of the connector housing. Hence, a large number of steps are required, so that the manufacturing cost becomes high. Moreover, it is difficult to shorten the required time for delivery of such connectors including electric wires, and this problem becomes remarkable in a multi-pole connector in which one connector has a large number of contacts. In this respect, an insulation displacement connector having contacts for insulation displacement of cores of electric wires is resolutely advantageous. The insulation displacement connector can achieve reduction in the manufacturing cost and shortening the required time for delivery of such a connector including an electric wire regardless of the number of poles. This is because insulation displacement of electric wires to the insulation displacement connector is performed by pressing all electric wires simultaneously into slots of contacts by an insulation displacement machine in the condition that all the contacts are inserted into the cavities of the connector housing. Generally, the insulation displacement machine has an insulation displacement stand for supporting the insulation displacement connector, and a movable unit which moves back and forth relative to the insulation displacement stand. Electric wire insertion holes communicating with the slots of the contacts are opened in one outer wall of the connector housing of the insulation displacement connector. The other outer wall opposite to the one outer wall is provided as a pressure-receiving wall so that an insulation displacement load is received by the pressure-receiving wall. The insulation displacement connector is set in the insulation displacement machine so that the pressure-receiving wall comes into contact with the insulation displacement stand. The electric wires are positioned on the electric wire insertion holes and pressed by a punch mounted in the movable unit so that the electric wires are forced into the slots. In this manner, insulation displacement is performed simultaneously.

If the aforementioned locking mechanism is provided in the insulation displacement connector, reduction in the manufacturing cost and shortening in the required time for delivery of such a connector including an electric wire, which are advantages of the insulation displacement connector, can be achieved while connection failure due to the locking mechanism is prevented from occurring between the connector and a partner connector. In such a case, however, the locking mechanism is provided in the pressure-receiving wall in the condition that the locking mechanism does not disturb insertion of the electric wires into the electric wire insertion holes. If so, the pressure-receiving wall cannot come into surface contact with the insulation displacement stand of the insulation displacement machine because of interference of the locking mechanism. Hence, the load for insulation displacement cannot be received by the insulation displacement connector steadily, so that the electric wires cannot be connected with the connector by the insulation displacement machine. Particularly in a multi-pole connector, this problem becomes serious because the load for insulation displacement becomes large. For this reason, there is no insulation displacement connector including a locking mechanism which has been put into practical use.

In such a multi-pole connector, when one end side of a contact raw receives stronger draw-out force than the draw-out force acting on the other end side in the condition that draw-out force from the electric wires acts on the connector, the connector is inclined to the partner connector. Hence, the one end side is floated up from the partner connector, and there is therefore a problem that contact failure occurs between the one-end side contact and the partner contact. Particularly such a connector including a locking mechanism is apt to face such a problem because the connector is often used in the condition that intensive draw-out force acts on the connector. It is also preferable from the point of view of preventing connection failure that a sense of completion of connection (hereinafter referred to as clicking sense) is obtained intensively when the connector is connected to the partner connector.

SUMMARY OF THE INVENTION

The present invention is designed upon such circumstances and an object of the present invention is to provide an insulation displacement connector provided with a locking mechanism in which: a portion of a connector housing for receiving slots of contacts is shifted to the longitudinal direction of the contacts more than a locking mechanism so that a pressure-receiving wall for receiving a load for an insulation displacement is secured to make it possible to connect electric wires with an insulation displacement machine; and the fitting length of the contacts is kept sufficient so that connection failure can be prevented and an intensive clicking sense can be obtained even in the case where the insulation displacement connector suffers draw-out force from the electric wires.

In order to achieve the above object, the insulation displacement connector according to a first aspect of the invention has a feature that the insulation displacement connector comprises: male or female contacts each having a connection portion and slots, the connection portion being provided at a front end and being brought into contact with a partner contact on an assumption that a lengthwise direction is regarded as a front-rear direction, the slots being opened toward one heightwise direction perpendicular to the front-rear direction with insulation displacement and being provided in a side more rear than the connection portion for fitting a core at a front end of an electric wire inserted from the one heightwise direction; a connector housing having cavities, the cavities being formed so as to pierce the connector housing in the front-rear direction and for receiving the contacts; a holding mechanism for holding the contacts in the connector housing; a support portion formed so as to protrude outward from an outer wall at one of ends, in the heightwise direction, of the connector housing; and an arm extending in the front-rear direction and having an intermediate portion or a rear end connected to the support portion and having an engaging portion provided at a front end of the arm so that the engaging portion engages with the partner connector; wherein a connector housing rear half portion of the connector housing for receiving the slots of the contacts is provided in a side more rear than the support portion and the arm; wherein electric wire insertion holes communicating respectively with the slots are opened in one outer wall located at the one end, in the heightwise direction, of the connector housing rear half portion; and wherein a portion, corresponding to the slots, of the other outer wall opposite to the one outer wall is provided as a pressure-receiving wall for receiving an insulation displacement load.

In the insulation displacement connector, the connector housing rear half portion is located at the side more rear than the support portion and the arm. Hence, electric wire insertion holes are opened in one outer wall located at one end, in the heightwise direction, of the connector housing rear half portion. Moreover, a portion, corresponding to the slots, of the other outer wall opposite to the one outer wall is provided as a pressure-receiving wall. Even in this case, the pressure-receiving wall can come into surface contact with the insulation displacement stand of the insulation displacement machine without being interfered by the locking mechanism. Hence, the insulation displacement load can be received by the insulation displacement wall steadily regardless of the number of poles, so that the electric wires can be fit by the insulation displacement machine. That is, if the insulation displacement connector is set in the insulation displacement machine in the condition that the pressure-receiving wall of the connector housing rear half portion comes into contact with the insulation displacement stand, and if front ends of the electric wires are then positioned respectively on the electric wire insertion holes and pressed by a punch so that the electric wires are forced into the slots, simultaneous insulation displacement can be performed. Hence, the insulation displacement connector including the locking mechanism can achieve reduction in machining cost and shortening in the time of delivery of the connector including electric wires because the insulation displacement connector is supposed to be superior in this respect to a crimp style connector.

When the insulation displacement connector is connected to the partner connector, the engaging portion of the arm of the locking mechanism is engaged with the engaged portion of the partner connector so that the two connectors are connected to each other strongly. Hence, even in the case where the insulation displacement connector suffers draw-out force from the electric wires, the insulation displacement connector is hardly drawn out from the partner connector to thereby prevent connection failure from occurring. When the gripping portion is then pushed, the fitting is released so that the insulation displacement connector can be removed from the partner connector easily.

Moreover, the connector housing rear half portion for receiving the slots of the contacts is provided on the side more rear than the support portion and the arm. Front ends of cores of the electric wires are positioned on the rear side correspondingly, so that the connection portion of each contact can be set longer. Hence, the fitting length of the contact can be set longer. Even in the case where the insulation displacement connector suffers draw-out force from the electric wires, connection failure caused by inclination of the insulation displacement connector or the like can be prevented and an intensive clicking sense can be obtained.

The insulation displacement connector according to a second aspect of the invention has a feature that in the configuration stated in the first aspect of the invention, the pressure-receiving wall is formed to be in a solid state.

In such a manner, the strength of the pressure-receiving wall is improved. Hence, the insulation displacement load acting on the contacts is received by the pressure-receiving wall steadily and transmitted to the insulation displacement stand securely. Hence, the electric wires can be fit more steadily by the insulation displacement machine.

The insulation displacement connector according to a third aspect of the invention has a feature that in the configuration stated in the first or second aspect of the invention, the engaging portion is shaped like a hook curved toward the outer wall portion of the connector housing, an engaged portion is provided in an outer wall of the partner connector so that the hook-like engaging portion is grappled with the engaged portion, and the arm has the intermediate portion connected to the support portion and has a gripping portion provided at a rear end.

In such a manner, when the insulation displacement connector is connected to the partner connector, the engaging portion of the arm in the locking mechanism rides over a surface of the engaged portion of the partner connector in the farther side from the connector housing and is then engaged with the engaged portion so that the two connectors are coupled to each other. When the gripping portion is then pressed toward the connector housing, the fitting is released so that the insulation displacement connector is removed from the partner connector. Such a locking mechanism which locks the connector housing of the partner connector from its outside is called an outer lock type.

The insulation displacement connector according to a fourth aspect of the invention has a feature that in the configuration stated in the first or second aspect of the invention, the engaging portion is shaped like a hook curved so as to depart from an outer wall portion of the connector housing, and an engaged portion is provided in the outer wall of the partner connector so that the hook-like engaging portion is grappled with the engaged portion.

In such a manner, when the insulation displacement connector including the locking mechanism is connected to the partner connector, the engaging portion of the arm in the locking mechanism rides over a surface of the engaged portion of the partner connector in the nearer side to the connector housing and is then engaged with the engaged portion so that the two connectors are coupled to each other. When the intermediate portion of the arm is then pressed toward the connector housing, the fitting is released so that the insulation displacement connector is removed from the partner connector. Such a locking mechanism which enters the inside of the connector housing of the partner connector is called an inner lock type.

The insulation displacement connector according to a fifth aspect of the invention, has a feature that in the configuration stated in any one of the first to fourth aspects of the invention, the holding mechanism is a contact lance mechanism or a housing lance mechanism.

In such a manner, the contact lance mechanism or housing lance mechanism is higher in holding force than the press-in mechanism. Hence, the contacts are hardly removed from the connector housing even in the case where the contacts suffer draw-out force from the electric wires.

The insulation displacement connector according to a sixth aspect of the invention has a feature that in the configuration stated any one of the first to fifth aspects of the invention, the holding mechanism further has a press-in mechanism.

If the contact lance mechanism or housing lance mechanism is rickety, there is a possibility that the position of each slot may be displaced from its regular position when the insulation displacement connector is set in the insulation displacement machine. On this occasion, the electric wires cannot be fit well. However, according to the sixth aspect of the invention, the position of each contact in the connector housing is settled before insulation displacement. Accordingly, when the insulation displacement connector is set in the insulation displacement machine, any slot is not displaced and the electric wires can be fit to the insulation displacement connector securely by the insulation displacement machine.

DETAILED DESCRIPTION OF THE PREFERRED EMBODIMENTS

Figure 1:
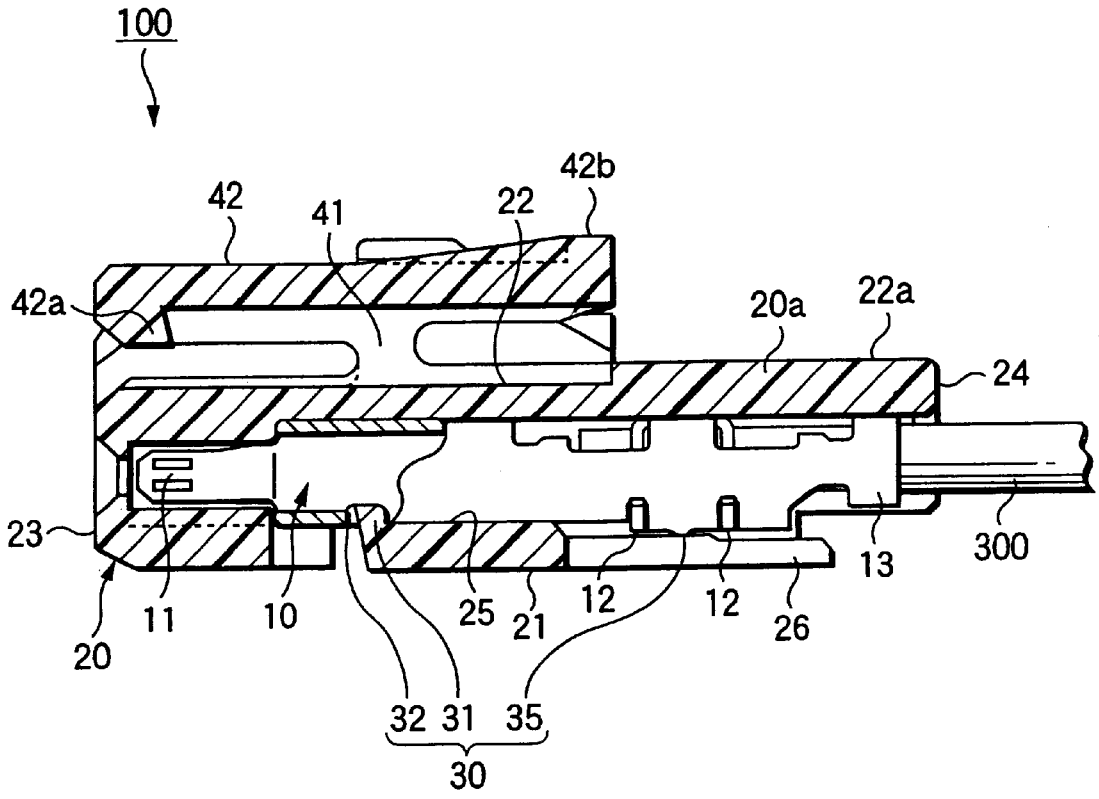
FIG. 1 is a longitudinal sectional view of an insulation displacement connector according to a first embodiment.
Figure 2:
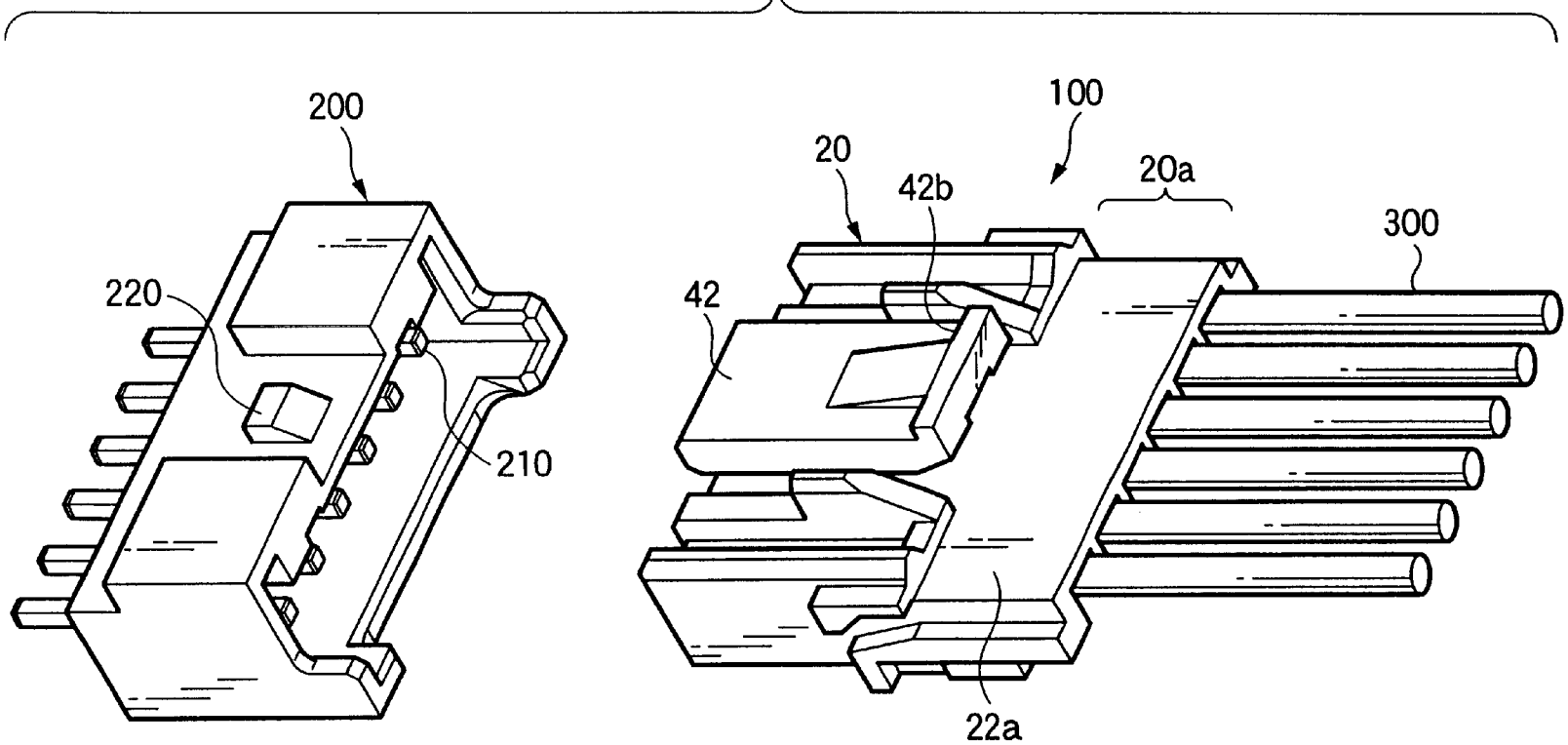
FIG. 2 is a perspective view showing the insulation displacement connector and a partner connector.
Figure 3:
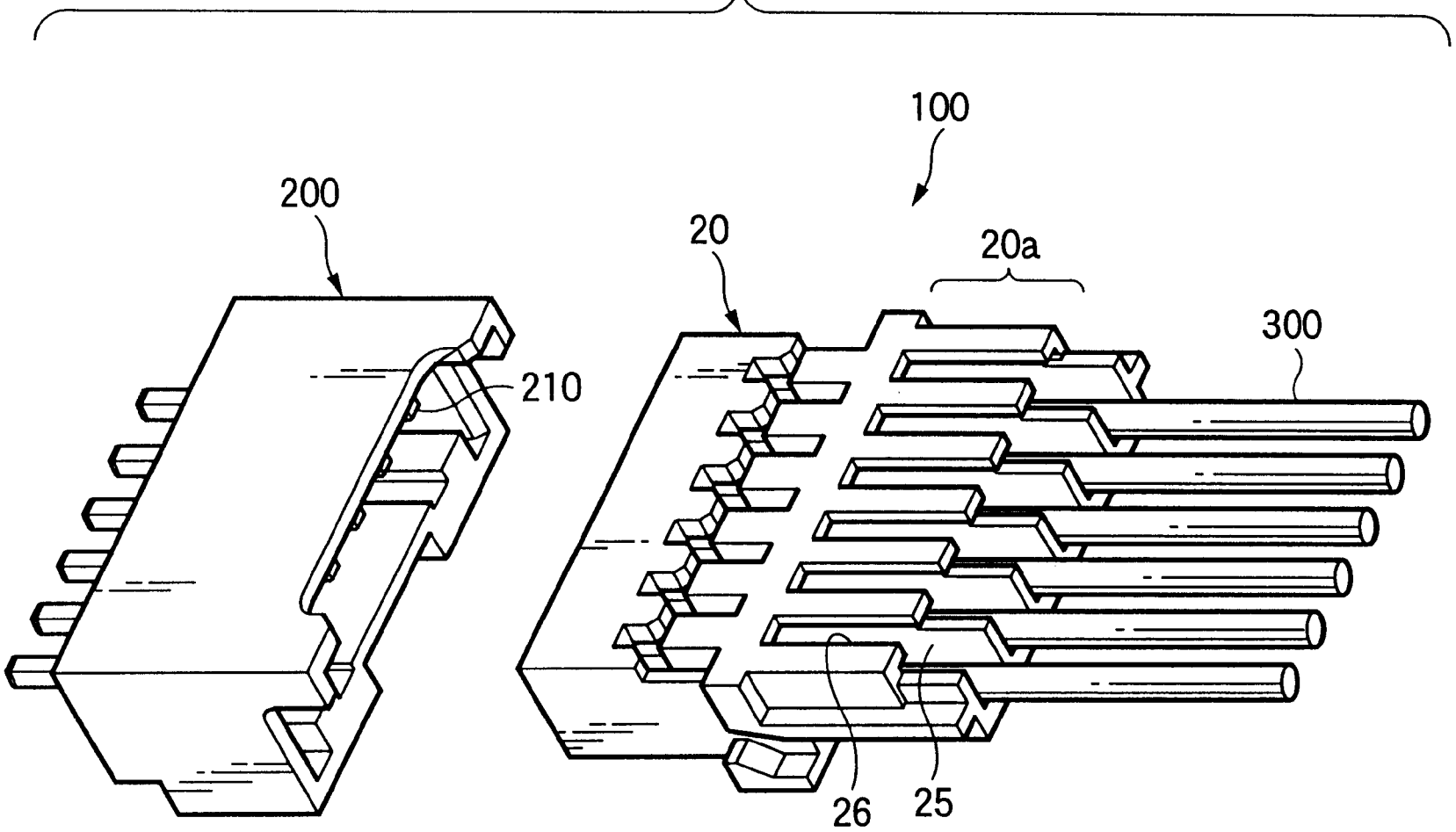
FIG. 3 is a perspective view of the insulation displacement connector and the partner connector from another angle.

Embodiments of an insulation displacement connector according to the present invention will be described below. FIGS. 1 to 3 show an insulation displacement connector 100 including a locking mechanism according to a first embodiment. Although here is shown a six-pole insulation displacement connector 100 as an example, the number of poles in the insulation displacement connector according to the present invention is not limited but can be selected at option. Electric wires 300 of the number corresponding to the number of poles are connected to the insulation displacement connector 100. The insulation displacement connector 100 is connected to a partner connector 200. Although a base connector to be mounted on a printed wiring board is illustrated as the partner connector 200, the type of the partner connector to be coupled with the insulation displacement connector according to the present invention is not limited thereto. For example, the partner connector may be a connector having electric wires mounted therein.

Figure 4A:
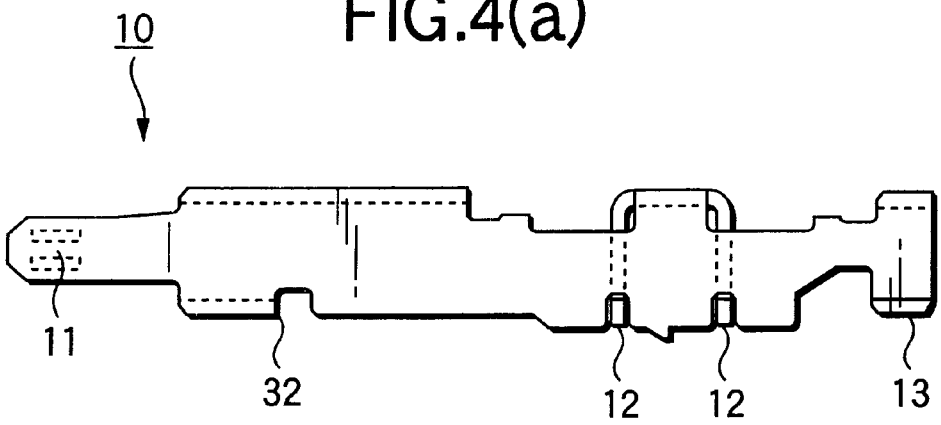
FIGS. 4(*a*), 4(*b*) and 4(*c*) show a contact of the insulation displacement connector; (a) being a side view, (b) being a plan view, (c) being a view from a rear end.
Figure 4B:
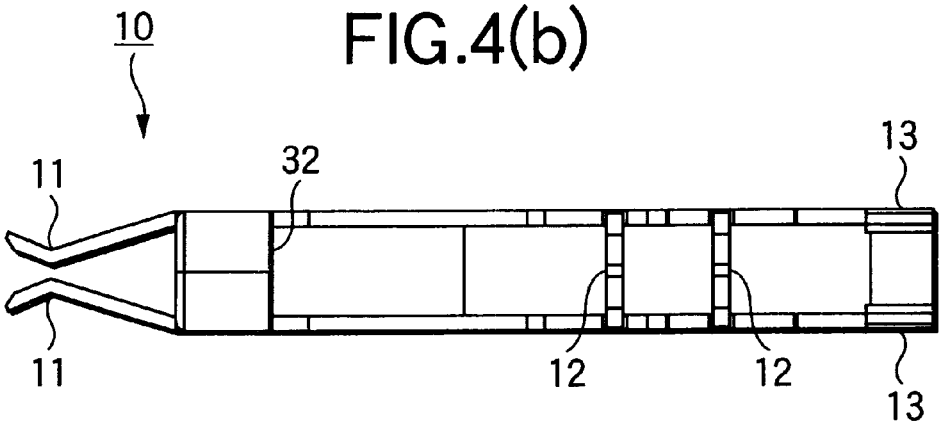
Figure 4C:
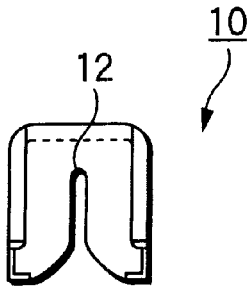

In these drawings, the reference numeral 10 designates each insulation displacement contact; and 20, a connector housing in which the contact 10 is inserted. FIG. 4 shows the contact 10. Now, directions are defined for the sake of convenience of description. Assume that the longitudinal direction of the contact 10 is a front-rear direction, a direction perpendicular to the front-rear direction is a heightwise direction, and a direction perpendicular both to the front-rear direction and to the heightwise direction is a widthwise direction. This direction definition will applies also to the description of other members. Incidentally, the direction definition has no relation with the direction in which the insulation displacement connector is used. As shown in FIG. 4, a connection portion 11 which comes into contact with a corresponding contact 210 of the partner connector 200 is provided at a front end of the contact 10. In this embodiment, because the contact 10 is of a female type, the connection portion 11 is shaped like a recess for receiving a connection portion of the male-type partner contact 210. If the contact 10 is of a male type conversely, the connection portion 11 will be shaped like a protrusion for running into a corresponding connection portion of a female type partner contact 210. Slots 12 which are opened toward one of heightwise direction and which are provided for insulation displacement of a core at a front end of a corresponding electric wire 300 inserted from this direction are provided in the contact 10 on the side more rear than the connection portion 11. As shown in FIG. 4, a plate-like member positioned in the front-rear direction is grooved from one heightwise direction to thereby form the slots 12. Although here is shown the case where two slots 12 are provided in one contact 10, the number of slots can be selected at option. Further, an insulation barrel 13 is provided at the rear end of the contact 10 as occasion demands. The insulation barrel 13 comes into contact with an electrically insulating coating of the electric wire 300 by insulation displacement to thereby increase the holding power of the contact 10 for holding the electric wire 300.

As shown in FIGS. 1 to 3, the connector housing 20 is shaped substantially like a rectangular parallelepiped. The connector housing 20 has a first outer wall 21 at one end in the heightwise direction, a second outer wall 22 at the other end opposite to the one end in the heightwise direction, a front wall 23 in the front, and a rear wall 24 in the rear.

Cavities 25 are provided in the connector housing 20 so as to pierce the connector housing 20 in the front-rear direction and so as to receive the contacts 10. Openings of the cavities 25 to the front wall 23 serve as insertion holes for inserting male contacts respectively. In this embodiment, the partner contacts 210 are received through the insertion holes. Openings of the cavities 25 to the rear wall 24 serve as drawer holes for drawing out the electric wires 300 respectively.

As shown in FIG. 1, a holding mechanism 30 for holding each contact 10 in the connector housing 20 is provided in the insulation displacement connector 100. The holding mechanism may include a contact lance mechanism, a housing lance mechanism and a press-in mechanism, and these mechanisms may be combined suitably. The holding mechanism 30 according to the embodiment is a housing lance mechanism. That is, a protrusion is formed on the inner wall surface of each cavity 25 of the connector housing 20 so that the protrusion serves as a lance 31. A lock portion for locking the lance 31 is correspondingly formed in the contact 10. Here, a bottom wall 32 formed in the front portion of the contact 10 serves as the lock portion. When the contact 10 is inserted in the cavity 25, the bottom wall 32 pushes down the lance 31 by use of its flexibility to thereby ride over the lance 31 to the front side of the lance 31. The rear end of the bottom wall 32 is caught in the lance 31 to thereby prevent the contact 10 from dropping out from the cavity 25. Incidentally, the contact lance mechanism has a lance which is a protrusion formed on the outer wall surface of the contact, and a lock portion which is formed on the inner wall surface of the cavity of the connector housing to thereby lock the lance. The press-in mechanism is a mechanism in which the outer wall surface of the contact and the inner wall surface of the cavity are partially formed into tight-fitting size so that the contact is forced into the cavity to thereby be held in the cavity.

As shown in FIGS. 1 and 4, in the insulation displacement connector 100, the holding mechanism 30 further has a press-in mechanism. That is, a press-in protrusion 35 is formed on the outer wall surface of the contact 10. Concentrated contact force acts between the press-in protrusion 35 and the inner wall surface of the cavity 25 to thereby hold the contact 10 in the cavity 25. The press-in is performed when the contact 10 is inserted in the cavity 25.

As shown in FIGS. 1 and 2, a locking mechanism is provided in the insulation displacement connector 100. That is, a support portion 41 and an arm 42 are provided in the insulation displacement connector 100. The support portion 41 is formed to protrude outward from the second outer wall 22 which is formed at one end, in the heightwise direction, of the connector housing 20, while the arm 42 extends in the front-rear direction to have an intermediate portion connected to the support portion 41 and has an engaging portion 42*a* at the front end so as to be engaged with the partner connector 200. In this embodiment, the locking mechanism is of a so-called outer lock type. Hence, the engaging portion 42*a* is shaped like a hook which is curved toward the second outer wall 22 of the connector housing 20. An engaged portion 220 to grapple with the hook-like engaging portion 42*a* is provided on the outer wall of the partner connector 200. Further, a gripping portion 42*b* is provided at the rear end of the arm 42.

As shown in FIGS. 1 to 3, in the connector housing 20, a connector housing rear half portion 20*a* is provided to receive the slots 12 of the contacts 10 on the side more rear than the support portion 41 and the arm 42. Further, electric wire insertion holes 26 communicating with the slots 12 are opened in the first outer wall 21 located at one end, in the heightwise direction, of the connector housing rear half portion 20*a*. A portion of the second outer wall 22 corresponding to the slots 12 is located at the other end, in the heightwise direction, of the connector housing rear half portion 20*a* and opposite to the first outer wall 21. The portion of the second outer wall 22 is formed as a pressure-receiving wall 22*a* for receiving an insulation displacement load. In this case, only the portion corresponding to the slots may be formed as a pressure-receiving wall. Further, the whole surface of the second outer wall 22 on the connector housing rear half portion 20*a* may be formed as a pressure-receiving portion 22*a* as shown in this embodiment. If so, insulation displacement force can be diffused preferably. The pressure-receiving wall 22*a* is formed to be in a solid state. That is, the pressure-receiving wall 22*a* has no through-hole and no cavity. The pressure-receiving wall 22*a* may be shaped like a flat plate or a curved plate or may be provided with ribs. If the outer surface of the pressure-receiving wall 22*a* is shaped like a plane, transmission of insulation displacement force to an insulation displacement stand is made uniform preferably.

Figure 5A:
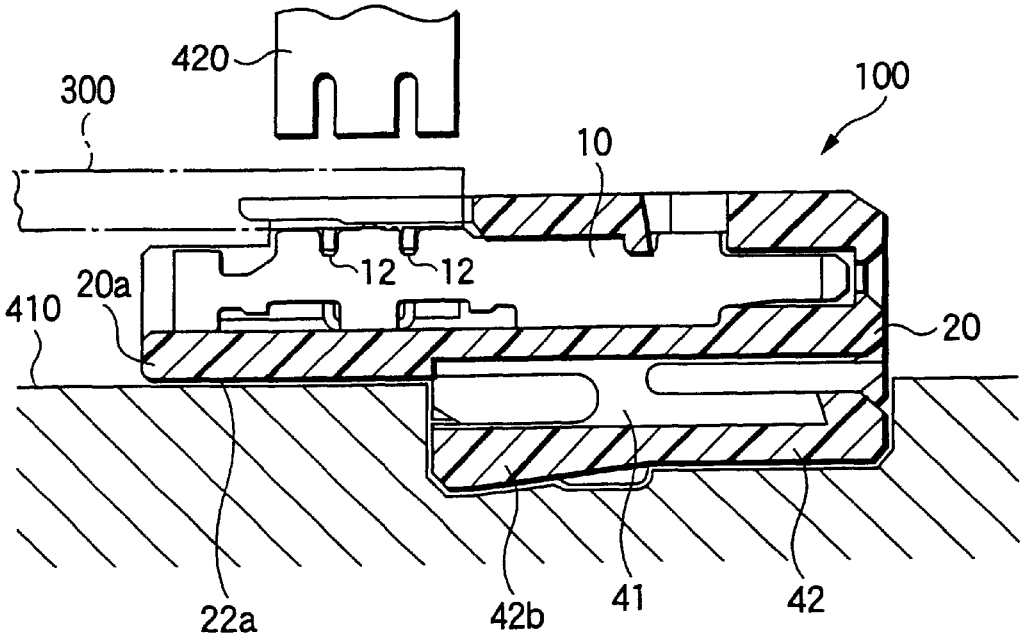
FIGS. 5(*a*) and 5(*b*) are longitudinal sectional views showing the step of fitting electric wires to the insulation displacement connector by an insulation displacement machine; (a) showing the case of the first embodiment, (b) showing a comparative example.
Figure 5B:
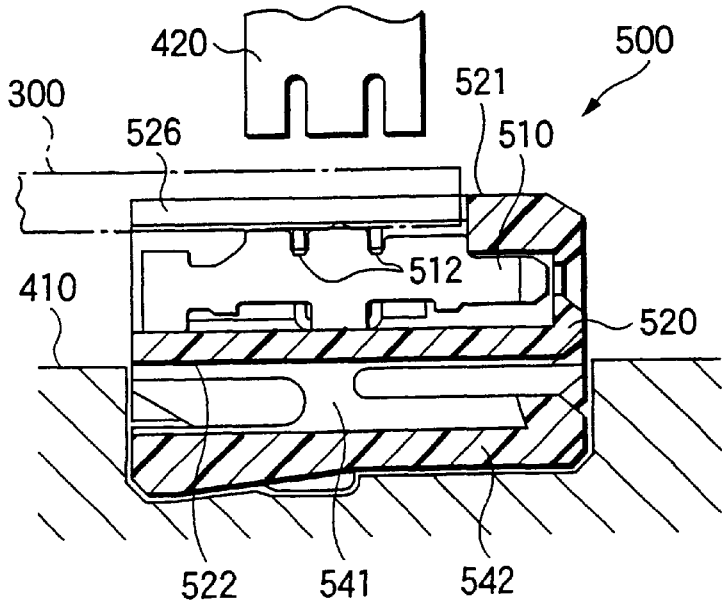
FIG.5(b) BACKGROUND ART

The operation and effect of the first embodiment will be described below. First, in an insulation displacement connector 500 including a locking mechanism as a comparative example shown in FIG. 5(*b*), electric wire insertion holes 526 are merely opened in a first outer wall 521 located at one end of a connector housing 520 in the heightwise direction, and a locking mechanism constituted by a support portion 541 and an arm 542 is provided on a second outer wall 522 opposite to the first outer wall 521. In this comparative example, even if the second outer wall 522 on which the locking mechanism is provided tries to receive an insulation displacement load, the second outer wall 522 cannot come into surface contact with an insulation displacement stand 410 of an insulation displacement machine because of interference of the locking mechanism. Hence, the insulation displacement load cannot be received by the insulation displacement connector 500 steadily, so that the electric wires 300 cannot be fit into slots 512 of contacts 510 by the insulation displacement machine. This problem is particularly serious in a multi-pole connector because the insulation displacement load is large. On the contrary, in the insulation displacement connector 100 according to the first embodiment of the present invention, the connector housing rear half portion 20*a* is located at the side more rear than the support portion 41 and the arm 42. Hence, a portion of the second outer wall 22 corresponding to the slots 12 can be provided as a pressure-receiving wall 22*a* for receiving an insulation displacement load while the electric wire insertion holes 26 are opened to the first outer wall 21 located at one end of the connector housing rear half portion 20*a* in the height wise direction. In such a manner, the pressure-receiving wall 22*a* can come into surface contact with the insulation displacement stand 410 of the insulation displacement machine without interference of the locking mechanism. Hence, the insulation displacement load can be received by the insulation displacement connector 100 steadily regardless of the number of poles, so that the electric wires 300 can be fit by the insulation displacement machine. That is, as shown in FIG. 5(*a*), the insulation displacement connector 100 according to the first embodiment is set in the insulation displacement machine so that the pressure-receiving wall 22*a* of the connector housing rear half portion 20*a* comes into contact with the insulation displacement stand 410. Then, insulation displacement is performed simultaneously, when front ends of the electric wires 300 are positioned respectively in the electric wire insertion holes 26 and pressed by a punch 420 so that the front ends of the electric wires 300 are forced into the slots 12. Hence, the insulation displacement connector 100 can achieve reduction in machining cost and shortening in the time of delivery of the connector including an electric wire, while the insulation displacement connector is supposed to be superior in this respect to a crimp style connector. This effect can be obtained remarkably particularly in a multi-pole connector.

When the insulation displacement connector 100 is connected to the partner connector 200, the engaging portion 42*a* of the arm 42 in the locking mechanism is engaged with the engaged portion 220 of the partner connector 200 so that the two connectors 100 and 200 are connected to each other strongly. Hence, even in the case where the insulation displacement connector 100 suffers draw-out force from the electric wires 300, the insulation displacement connector 100 is hardly drawn out from the partner connector to thereby prevent connection failure from occurring. When the gripping portion 42*b* is pushed, the engagement is released so that the insulation displacement connector 100 can be removed from the partner connector 200 easily.

Figure 6A:
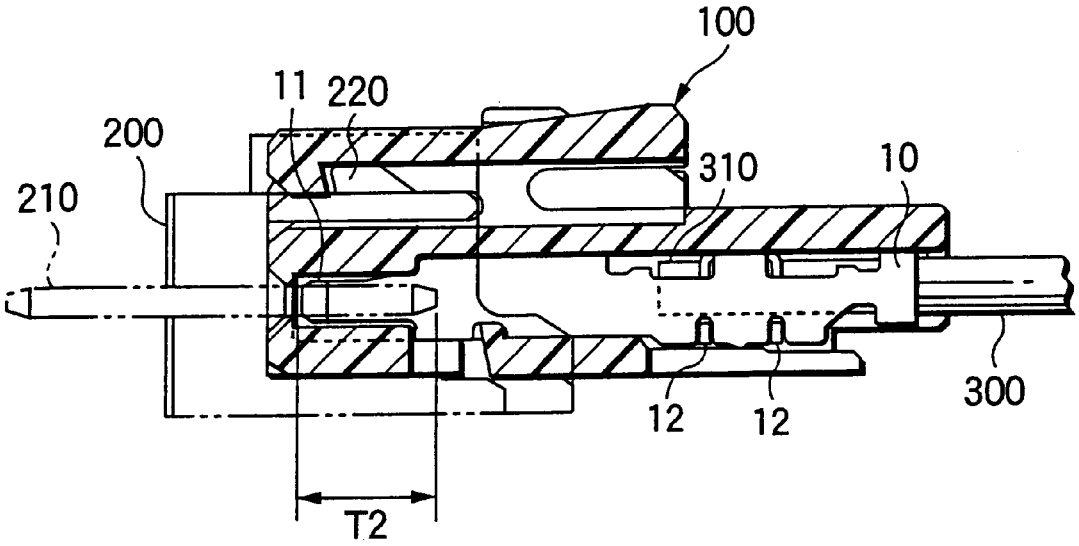
FIGS. 6(*a*) and 6(*b*) are longitudinal sectional views for explaining a fitting length; (a) showing the case of the first embodiment, (b) showing the comparative example.
Figure 6B:
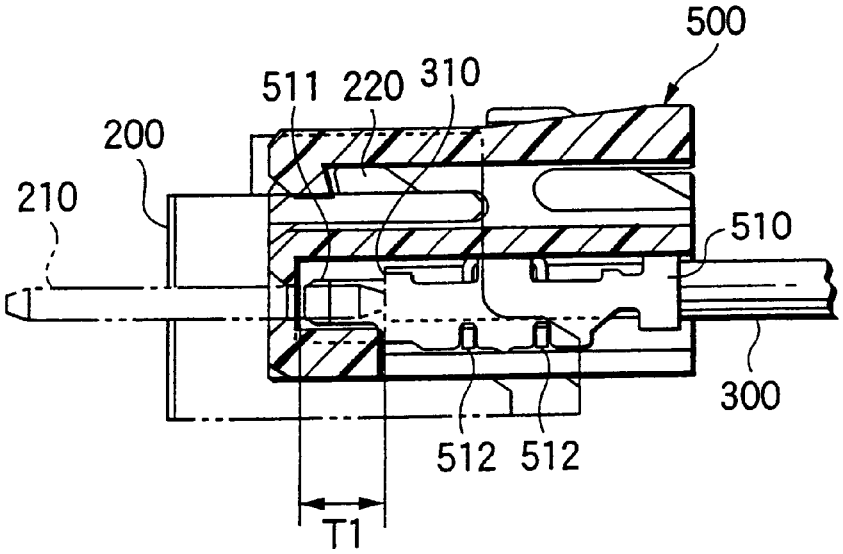
FIG.6(b) BACKGROUND ART
Figure 7:
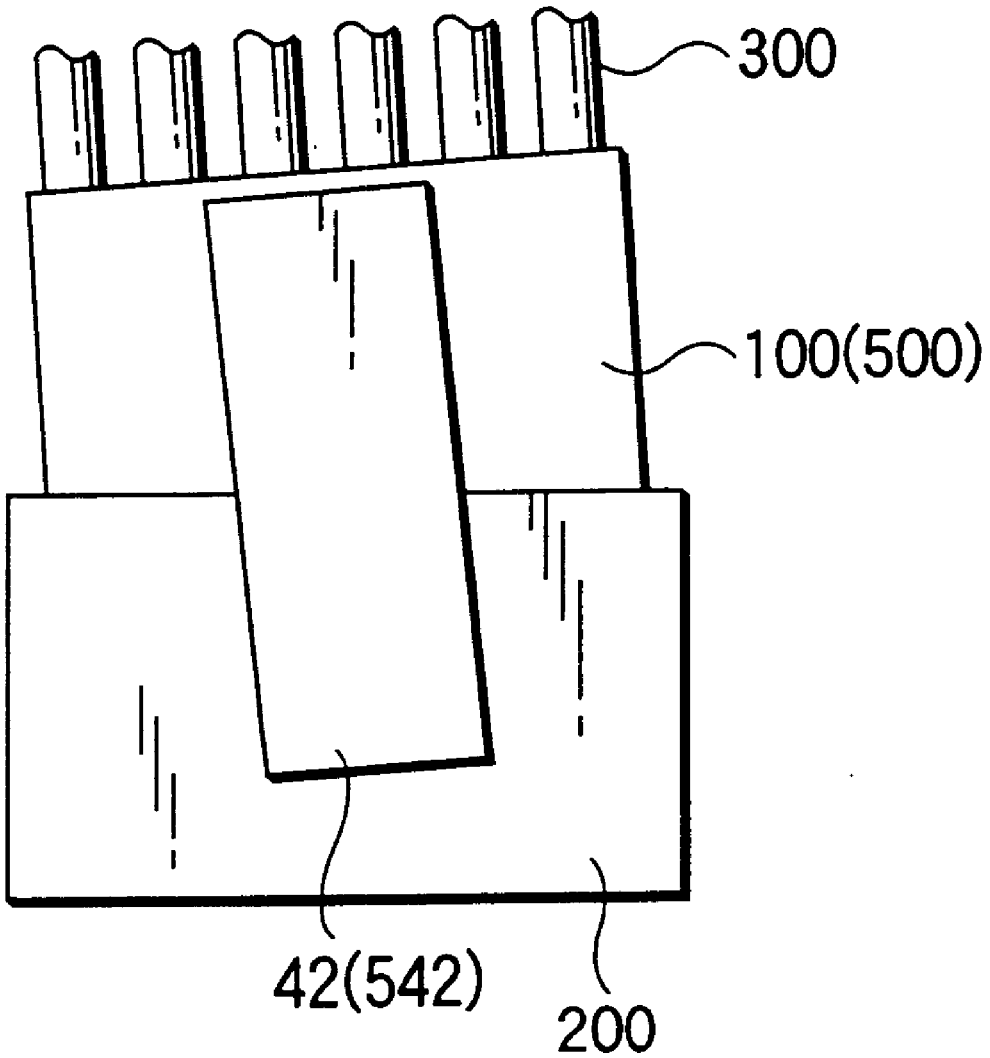
FIG. 7 is an explanatory view showing a state in which the insulation displacement connector suffers draw-out force from the electric wires so that the insulation displacement connector is inclined to the partner connector.

As shown in FIG. 6(*b*), in the insulation displacement connector 500 including the locking mechanism according to the aforementioned comparative example, an end surface 310 of each electric wire 300 is located in proximity to the connection portion 511 of the corresponding contact 510. Hence, the connection portion 511 becomes short, so that the fitting length between the connection portion 511 and the partner contact becomes short. If so, contact failure is apt to occur, and the reason is as follows. As shown in FIG. 7, the contact 510 of the insulation displacement connector 500 tries to go out from the partner contact 210 when draw-out force from the electric wire 300 acts on the insulation displacement connector 500 and when one end side of the contact raw suffers stronger draw-out force than that acting on the other end side of the contact raw so that the one end side of the contact raw is therefore floated up from the partner connector 200 while the insulation displacement connector 500 is inclined to the partner connector 200. On the contrary, in the insulation displacement connector 100 according to the first embodiment, as shown in FIG. 6(*a*), the connector housing rear half portion 20*a* for receiving the slots 12 of the contacts 10 is provided at the side more rear than the support portion 41 and the arm 42. Hence, the end surfaces 310 of the electric wires 300 are positioned on the rear side correspondingly. Accordingly, the connection portions 11 of the contacts 10 can be set longer. Hence, the fitting length T of each contact 10 can be set longer. If so, the contacts 10 and 210 come into contact with each other sufficiently continuously even in the case where the insulation displacement connector 100 suffers draw-out force from the electric wire 300 and is inclined to the partner connector 200, as shown in FIG. 7. Hence, contact failure can be prevented. This effect can be obtained remarkably particularly in a multi-pole connector.

Figure 8:
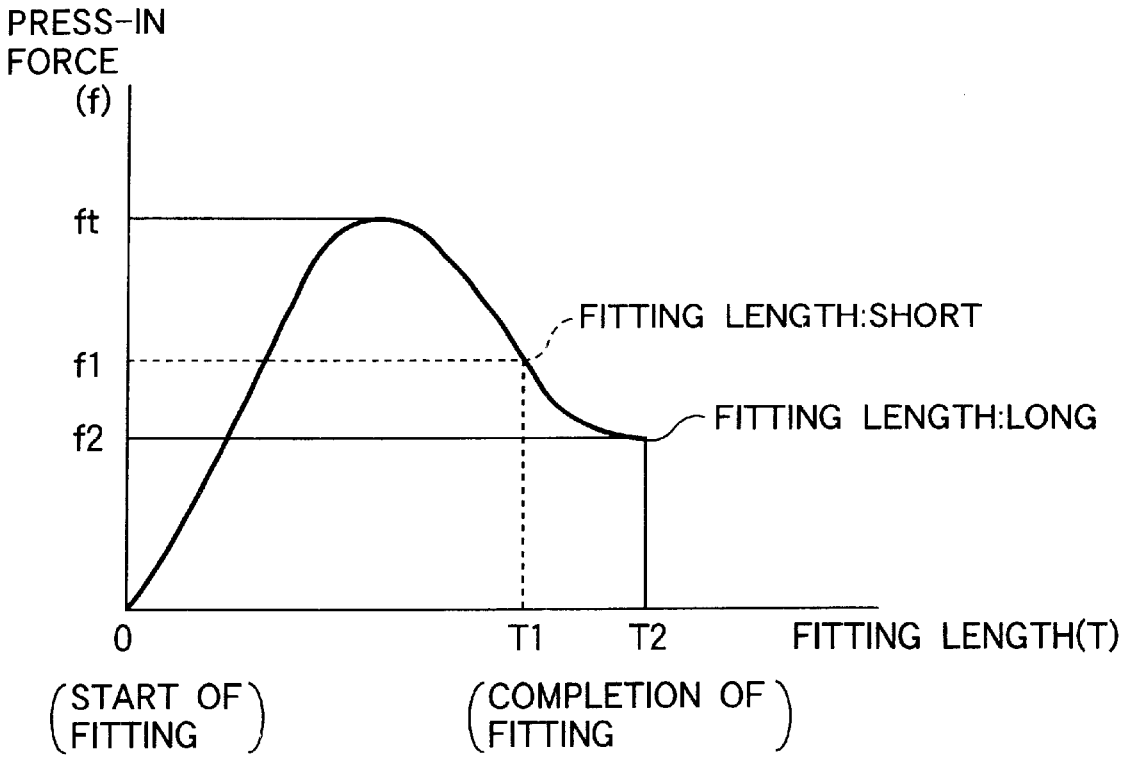
FIG. 8 is an explanatory view showing the relation between press-in force f and fitting length between two contacts in the case where the insulation displacement connector is connected to the partner connector.

FIG. 8 shows the relation between press-in force f and fitting length T between two contacts in the case where the insulation displacement connector is connected to the partner connector. When the insulation displacement connector is forced into the partner connector, the press-in force f increases to an upper limit value, then decreases to a lower limit value, and then increases again. When the fitting length T reaches its limit, the press-in force f becomes infinitely large. It is assumed that a sense of completion of strong connector connection, that is, an intense clicking sense is obtained as the difference between the upper and lower limit values of the press-in force f produced in the aforementioned period is large. In the contact 510 according to the comparative example, the clicking sense is weak because the fitting length T between the contact 510 and the partner contact 210 is Ti to be so short that the difference (ft−f1) between the upper limit value ft of the press-in force f and the lower limit value f1 of the press-in force f is small. On the contrary, in the insulation displacement connector 100 according to the first embodiment, an intensive clicking sense is obtained because the fitting length T of the contact 10 is T2 to be so long that the difference (ft−f2) between the upper limit value ft of the press-in force f and the lower limit value f2 of the press-in force f is large as shown in FIG. 8. An operator can confirm the completion of connection of the insulation displacement connector by this clicking sense. Hence, connection failure can be prevented from occurring. Therefore, this clicking sense is an important operating sense. In the first embodiment, this clicking sense is obtained intensively, so that prevention of occurrence of connection failure can be achieved securely compared with the comparative example.

The present invention includes all the embodiments in which electric wire insertion holes are opened in one outer wall located at one end, in the heightwise direction, of the connector housing rear half portion and in which a portion, corresponding to the slots, of the other outer wall opposite to the one outer wall is formed as a pressure-receiving wall for receiving an insulation displacement load. However, when the pressure-receiving wall 22*a* is formed to be in a solid state as shown in the aforementioned embodiment, the strength of the pressure-receiving wall 22*a* is improved. Hence, the insulation displacement load acting on the contacts 10 is received by the pressure-receiving wall 22*a* steadily and transmitted to the insulation displacement stand 410 securely. Hence, the electric wires 300 can be fit more steadily by the insulation displacement machine.

The present invention includes all the embodiments in which there are provided a support portion formed to protrude outward from an outer wall located at one end of the connector housing in the heightwise direction, and an arm extending in the front-rear direction to have an intermediate portion or a rear end connected to the support portion and having an engaging portion at a front end to be engaged with the partner connector. Especially, the locking mechanism exemplified in the insulation displacement connector 100 according to the aforementioned embodiment is of a so-called outer lock type. When the insulation displacement connector 100 is connected to the partner connector 200, the engaging portion 42*a* of the arm 42 of the locking mechanism rides over the surface of the engaged portion 220 of the partner connector 200 in the farther side from the connector housing and then engages with the engaged portion 220 to thereby connect the two connectors 100 and 200 to each other. When the gripping portion 42*b* is then pushed toward the connector housing 20, the engagement is released so that the insulation displacement connector 100 is removed from the partner connector 200.

The insulation displacement connector 100 has a housing lance mechanism. This mechanism is higher in holding force than the press-in mechanism. Hence, the contacts 10 are hardly removed from the connector housing 20 even in the case where the contacts 10 suffer draw-out force from the electric wires 300. Hence, occurrence of connection failure can be further prevented. This effect can be obtained in the aforementioned manner also in the case where a contact lance mechanism is provided in the insulation displacement connector.

It will go well, if the present invention includes at least one of the contact lance mechanism, the housing lance mechanism and the press-in mechanism as a holding mechanism. However, if the housing lance mechanism or the contact lance mechanism provided in the insulation displacement connector is rickety, there is the possibility that the position of each slot may be displaced from its regular position when the insulation displacement connector is set in the insulation displacement machine. In this case, the electric wires cannot be fit well. However, in the insulation displacement connector 100 according to the aforementioned embodiment, the press-in mechanism is provided as a holding mechanism in addition to the housing lance mechanism. Hence, the position of each contact 10 in the connector housing 20 is settled, so that the electric wires 300 can be fit to the insulation displacement connector 100 securely by the insulation displacement machine without any displacement of the slots 12 when the insulation displacement connector 100 is set in the insulation displacement machine. This effect can be obtained in the aforementioned manner even in the case where a press-in mechanism is provided as a holding mechanism in addition to the contact lance mechanism.

Figure 9:
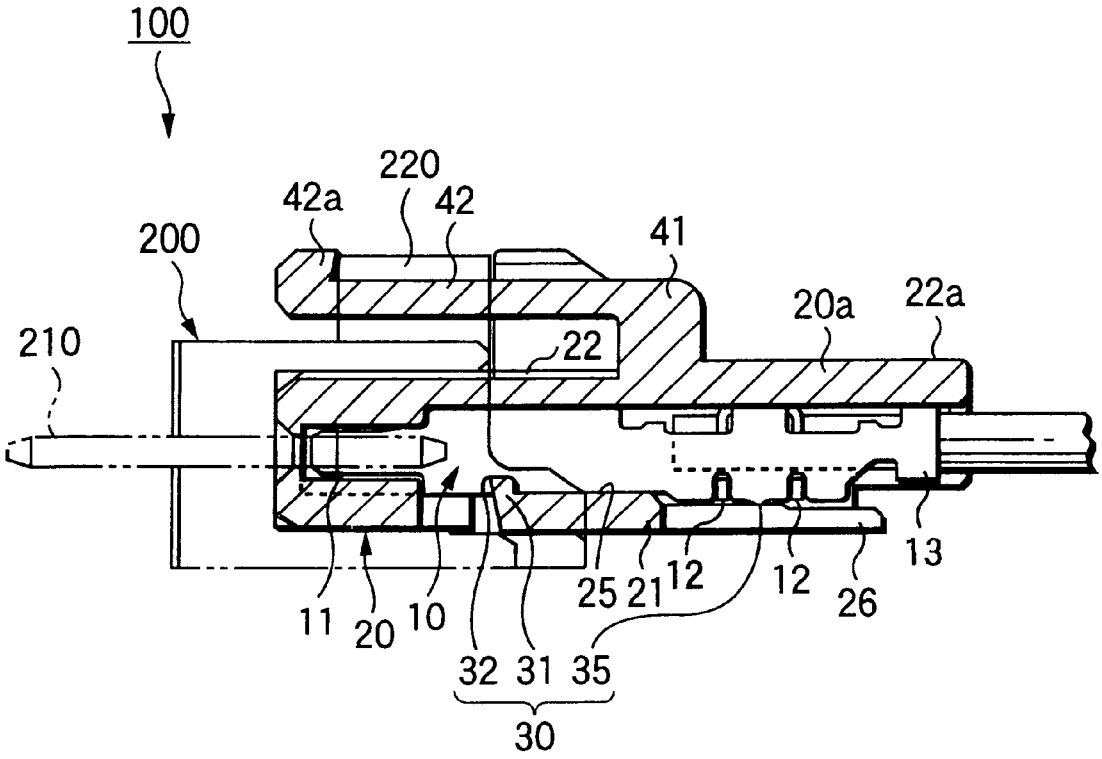
FIG. 9 is a view corresponding to FIG. 1 and showing a second embodiment.

A second embodiment will be described below with reference to FIG. 9. Parts fulfilling the same functions as those in the first embodiment are referenced correspondingly and the description of the parts will be therefore omitted. Although the insulation displacement connector according to the first embodiment has a so-called outer lock type locking mechanism, the insulation displacement connector according to the second embodiment has a so-called inner lock type locking mechanism. That is, the arm 42 extends in the front-rear direction so that an intermediate portion or a rear end of the arm 42 is connected to the support portion 41. The arm 42 has an engaging portion 42*a* at its front end so that the engaging portion 42*a* is engaged with the partner connector 200. The engaging portion 42*a* is shaped like a hook which is curved so as to depart from the second outer wall 22 of the connector housing 20. An engaged portion 220 to be grappled with the hook-like engaging portion 42*a* is provided in the outer wall of the partner connector 200. No gripping portion as in the first embodiment is provided.

When the insulation displacement connector 100 including the locking mechanism according to the second embodiment is connected to the partner connector 200, the engaging portion 42*a* of the arm 42 of the locking mechanism rides over a surface of the engaged portion 220 of the partner connector 200 in the nearer side to the connector housing 20 and is then engaged with the engaged portion 220 to thereby connect the two connectors 100 and 200 to each other. When the intermediate portion of the arm 42 is then pressed toward the connector housing 20, the engagement is released so that the insulation displacement connector 100 is removed from the partner connector 200.

In the above embodiments, the support portion 41 and the arm 42 are provided on the second outer wall 22 opposite to the first outer wall 21 having the electric wire insertion holes 26 opened. Further, the pressure-receiving wall 22*a* is formed on the same second outer wall 22. Besides the embodiments, the present invention includes an embodiment in which a support portion and an arm are provided on a first outer wall having electric wire insertion holes opened and in which a pressure-receiving wall is formed on a second outer wall opposite to the first outer wall.

In the insulation displacement connector according to the first aspect of the invention, the rear half portion of the connector housing in which the slots of the contacts are received is shifted to the side more rear than the support portion and the arm of the locking mechanism. Hence, the outer wall of the connector housing rear half portion serves as a pressure-receiving wall for receiving an insulation displacement load. Hence, the insulation displacement load can be received by the insulation displacement connector steadily, so that the electric wires can be fit by the insulation displacement machine. Accordingly, even in the case where the insulation displacement connector suffers draw-out force from the electric wires, the locking mechanism can prevent the insulation displacement connector from being drawn out from the partner connector and can prevent connection failure from occurring. Moreover, because the insulation displacement connector is used, the reduction in machining cost and the shortening in the time of delivery of the connector including electric wires can be achieved. Moreover, because the fitting length of the contact can be kept sufficient, connection failure caused by inclination of the insulation displacement connector or the like can be prevented from occurring even in the case where the insulation displacement connector suffers draw-out force from the electric wires. In addition, an intensive clicking sense can be obtained so that occurrence of connection failure can be prevented when the insulation displacement connector is connected. These effects can be obtained remarkably particularly in a multi-pole connector. The insulation displacement connector is adapted for a connection portion of internal wiring in a pinball machine, a vending machine, a refrigerator, or the like, which often suffers intensive draw-out force.

According to the second aspect of the invention, the strength of the pressure-receiving wall is improved. Hence, the insulation displacement load acting on the contacts is received by the pressure-receiving wall steadily and transmitted to the insulation displacement stand securely. Hence, the electric wires can be fit more steadily by the insulation displacement machine.

According to the third aspect of the invention, the same effect as that in the first aspect of the invention can be obtained in an insulation displacement connector having a so-called outer lock type locking mechanism.

According to the fourth aspect of the invention, the same effect as that in the first aspect of the invention can be obtained in an insulation displacement connector having a so-called inner lock type locking mechanism.

According to the fifth aspect of the invention, there can be obtained holding force stronger than the holding force in the case where the holding mechanism is only one press-in mechanism. Hence, even in the case where the contacts suffer draw-out force from the electric wires, the contacts can be further hardly removed from the connector housing. Hence, occurrence of connection failure can be further prevented.

According to the sixth aspect, any slot is not displaced and the electric wires can be fit to the insulation displacement connector securely by the insulation displacement machine when the insulation displacement connector is set in the insulation displacement machine.

While only certain embodiments of the invention have been specifically described herein, it will be apparent that numerous modifications may be made thereto without departing from the spirit and scope of the invention.

What is claimed is:

1. An insulation displacement connector comprising:

a connector housing including a front wall, a rear wall opposite said front wall, and a cavity within said connector housing located in a front wall-rear wall direction for receiving at least one contact;

the at least one contact including a connection portion provided at the front wall so as to be brought into contact with a partner contact;

at least one slot opened in a heightwise direction perpendicular to the front wall-rear wall direction and located rearward of the connection portion configured to fit a core of an electric wire inserted from the heightwise direction with an insulation displacement load;

a holding mechanism configured to hold said contact in said connector housing;

a support portion configured to protrude outward from one of a first outer wall at a first end in the heightwise direction of said connector housing and a second outer wall at a second end in the heightwise direction of said connector housing;

an arm configured to extend in the front wall-rear wall direction and connected to said support portion in one of an intermediate portion and a rear portion of said support portion and including an engaging portion located at a front portion of said support portion for engaging with a partner connector;

at least one electric wire insertion hole opened in a surface of one of the first and second outer walls located rearward of the rearmost portion of said support portion and said surface of one of the first and second outer walls is configured to position the electric wire for insertion in the at least one slot; and a pressure-receiving wall configured to receive the insulation displacement load when the core of the electric wire is inserted and provided on one of the first outer wall and the second outer wall, located rearward of the rearmost portion of said support portion, and which is opposite to said at least one electric wire insertion hole, wherein a locking mechanism is provided by the support portion and the arm, a connector housing rear half portion of said connector housing is configured to receive the slot of said contact and is located to the rear of said support portion and said arm, and said at least one contact is one of a male and female contact.

2. The insulation displacement connector according to claim 1, wherein said pressure-receiving wall is formed to be in a solid state.

3. The insulation displacement connector according to claim 1, wherein:

the engaging portion of said arm is shaped like a hook curved toward the first and second outer wall portions of said connector housing;

an engaged portion is provided on an outer wall of the partner connector so that the engaging portion is grappled therewith; and said arm includes a gripping portion provided at a ear end thereof, and the intermediate portion of said arm is connected to said support portion.

4. The insulation displacement connector according to claim 1, wherein an engaged portion is provided on the outer wall of the partner connector so that the engaging portion is grappled therewith; and the engaging portion of said arm is shaped like a hook and departs from the first and second outer wall portions of said connector housing when grappling with the engaged portion.

5. The insulation displacement connector according to claim 1, wherein said holding mechanism includes at least one of a contact lance mechanism and a housing lance mechanism.

6. The insulation displacement connector according to claim 5, wherein said holding mechanism further includes a press-in mechanism.

7. An insulation displacement connector comprising:

a connector housing including a front wall, a rear wall opposite said front wall, and a cavity within said connector housing located in a front wall-rear wall direction for receiving at least one contact;

the at least one contact including a connection portion provided at the front wall so as to be brought into contact with a partner contact;

at least one slot opened in a heightwise direction perpendicular to the front wall-rear wall direction and located rearward of the connection portion configured to fit a core of an electric wire inserted from the heightwise direction with an insulation displacement load;

a holding mechanism configured to hold said contact in said connector housing;

a support portion configured to protrude outward from one of a first outer wall at a first end in the heightwise direction of said connector housing and a second outer wall at a second end in the heightwise direction of said connector housing;

an arm configured to extend in the front wall-rear wall direction and connected to said support portion in one of an intermediate portion and a rear portion of said support portion and including an engaging portion located at a front portion of said support portion for engaging with a partner connector;

at least one electric wire insertion hole opened in a surface of one of the first and second outer walls located rearward of the rearmost portion of said support portion and said surface of one of the first and second outer walls is configured to position the electric wire for insertion in the at least one slot; and a pressure-receiving wall configured to receive the insulation displacement load when the core of the electric wire is inserted and to come into surface contact with an insulation displacement stand of an insulation displacement machine without being interfered with by the locking mechanism, said pressure-receiving wall provided on one of the first outer wall and the second outer wall, located rearward of the rearmost portion of said support portion, and which is opposite to said at least one electric wire insertion hole, wherein a locking mechanism is provided by the support portion and the arm, a connector housing rear half portion of said connector housing is configured to receive the slot of said contact and is located to the rear of said support portion and said arm, and said at least one contact is one of a male and female contact.

8. The insulation displacement connector according to claim 7, wherein said pressure-receiving wall is formed to be in solid state.

9. The insulation displacement connector according to claim 7, wherein:

an engaged portion is provided on the outer wall of the partner connector so that the engaging portion is grappled therewith; and the engaging portion of said arm is shaped like a hook and departs from the first and second outer wall portions of said connector housing when grappling with the engaged portion.

10. The insulation displacement connector according to claim 7, wherein:

the engaging portion of said arm is shaped like a hook so as to depart from the first and second outer wall portions of said connector housing; and an engaged portion is provided on the outer wall of the partner connector so that the engaging portion is grappled therewith.

11. The insulation displacement connector according to claim 7, wherein said holding mechanism includes at least one of a contact lance mechanism and a housing lane mechanism.

12. The insulation displacement connector according to claim 10, wherein said holding mechanism further includes a press-in mechanism.

* * * * *